US005475407A

United States Patent [19]

Ohashi

[11] Patent Number: 5,475,407

[45] Date of Patent: Dec. 12, 1995

[54] INK EJECTING PRINTER HEAD

[75] Inventor: Yumiko Ohashi, Hashima, Japan

[73] Assignee: Brother Kogyo Kabushiki Kaisha, Nagoya, Japan

[21] Appl. No.: 215,482

[22] Filed: Mar. 21, 1994

[30] Foreign Application Priority Data

May 10, 1993 [JP] Japan ..... 5-108385

[51] Int. Cl.[6] ..... B41J 2/045

[52] U.S. Cl. ..... 347/69; 347/45

[58] Field of Search ..... 347/68, 69, 64, 347/45

[56] References Cited

U.S. PATENT DOCUMENTS

| | | | |
|---|---|---|---|
| 4,392,907 | 7/1983 | Shirato et al. | 347/64 X |
| 4,879,568 | 11/1989 | Bartky et al. | 347/69 |
| 4,887,100 | 12/1989 | Michaelis et al. | 347/69 |
| 4,992,808 | 2/1991 | Bartky et al. | 347/69 |
| 5,003,679 | 4/1991 | Bartky et al. | 29/25.35 |
| 5,016,028 | 5/1991 | Temple | 347/69 |
| 5,028,936 | 7/1991 | Bartky et al. | 347/69 |

FOREIGN PATENT DOCUMENTS

| | | | |
|---|---|---|---|
| 56-10471 | 2/1981 | Japan | 347/64 |
| 59-54568 | 3/1984 | Japan . | |
| 4039050 | 2/1992 | Japan . | |
| 5-269984 | 10/1993 | Japan | 347/69 |
| 2151555 | 7/1985 | United Kingdom . | |
| WO89/07752 | 8/1989 | WIPO . | |

*Primary Examiner*—Benjamin R. Fuller
*Assistant Examiner*—Alrick Bobb
*Attorney, Agent, or Firm*—Oliff & Berridge

[57] ABSTRACT

An organic material is used as the protective film in the ink ejecting printer head with the surface roughness Ra of the protective film is set to be no greater than 3 μm. Accordingly, the segregation of ink components is suppressed to ensure a smooth flow of ink. As a result, the variations in the volume of the ink droplets ejected is reduced and the ejecting stability is improved. Therefore, the ink ejecting printer head having such a protective film that is excellent in protection also improves the stability of the ejected ink droplets and can be manufactured at a low cost.

11 Claims, 6 Drawing Sheets

BONDING STRENGTH BETWEEN ORGANIC PROTECTIVE FILM AND ORGANIC ADHESIVE

BONDING STRENGTH BETWEEN INORGANIC PROTECTIVE FILM AND ORGANIC ADHESIVE

INK EJECTING PRINTER HEAD

BACKGROUND OF THE INVENTION

1. Field of the Invention

The invention relates to an ink ejecting printer head having at least one wall defining an ink chamber, the wall being formed of a piezoelectric ceramics plate.

2. Description of Related Art

As an ink ejecting printer head using a piezoelectric ceramics plate, there has conventionally been proposed a drop-on-demand type of ink ejecting printer head. In this type of ink ejecting printer head, the volume of a groove formed in a piezoelectric ceramics plate is changed by deforming the piezoelectric ceramics plate. When the volume is decreased, ink contained in the groove is expelled in the form of droplets from a nozzle, whereas when the volume is increased, additional ink is introduced from an ink supply passage into the groove. A plurality of such nozzles are arranged in a neighboring relationship to each other, and the ink droplets are expelled from desired ones of the nozzles according to desired print data to thereby form desired characters or images on a sheet of paper opposed to the nozzles.

This kind of ink ejecting printer head is disclosed in U.S. Pat. Nos. 4,879,568, 4,887,100, 4,992,808, 5,003,679, 5,028,936 and 5,016,028, for example. FIGS. 5 to 8 schematically show such a conventional ink ejecting printer head.

The structure of such a conventional ink ejecting printer head will now be described with reference to FIG. 5 showing a cross section thereof. The ink ejecting printer head comprises a piezoelectric ceramics plate 1 and a cover plate 2. The piezoelectric ceramics plate 1 has a plurality of grooves 12 and is polarized in a direction depicted by an arrow 4. The cover plate 2 is formed of a ceramics material or a resin material. The piezoelectric ceramics plate 1 and the cover plate 2 are bonded together by an adhesive layer 3 formed of an epoxy adhesive, for example, whereby the plural grooves 12 are formed as a plurality of ink channels. Each ink channel is rectangular in cross section and is elongated over the length of the piezoelectric ceramics plate 1. A plurality of side walls 11 defining the ink channels extend over the length thereof. The adhesive layer 3 is formed on the upper surface of each side wall 11. A pair of metal electrodes 13 for applying a driving electric field are formed on the opposed side surfaces of each groove 12 at an upper half portion thereof. A protective film 20 is formed so as to cover each metal electrode 13. All of the ink channels are filled with ink.

The operation of the ink ejecting printer head shown in FIG. 5 will be described with reference to FIG. 6. When the groove 12B, as an exemplary one of the grooves 12, is selected according to desired print data, a positive driving voltage is rapidly applied to the metal electrodes 13E and 13F formed on the inside of the groove 12B, and the metal electrodes 13D and 13G formed on the outside of the groove 12B are grounded. As a result, a driving electric field having a direction 14B is generated in the side wall 11B, and a driving electric field having a direction 14C is generated in the side wall 11C.

As the directions 14B and 14C of the driving electric fields are perpendicular to the direction 4 of polarization of the piezoelectric ceramics plate 1, the side walls 11B and 11C are rapidly deformed inwardly of the groove 12B by a piezoelectric thickness shear effect. This deformation of the side walls lib and 11C reduces the volume of the groove 12B to rapidly increase the pressure of the ink contained in the groove 12B and thereby generates a pressure wave. As a result, the ink droplets are expelled from a nozzle 32 (refer to FIG. 7) communicating with the groove 12B. Further, when the application of the driving voltage is gradually stopped, the side walls 11B and 11C gradually restore to their original positions before deformation, and the pressure of the ink contained in the groove 12B is therefore gradually decreased. As a result, additional ink is supplied from an ink inlet hole 21 (refer to FIG. 7) through a manifold 22 (refer to FIG. 7) into the groove 12B.

In an actual product, however, a driving voltage may be applied in a direction reverse to the above to supply the ink into the groove 12B before expelling the ink, and thereafter the application of the driving voltage may be rapidly stopped to return the side walls 11B and 11C to the original positions and thereby expel the ink.

The construction and a manufacturing method for the ink ejecting printer head shown in FIG. 5 will now be described with reference to FIG. 7 showing a perspective view thereof. The grooves 12 are formed in the piezoelectric ceramics plate 1 by cutting with use of a thin, disk-shaped diamond blade. All of the grooves 12 are parallel and have the same depth over almost the entire length of the piezoelectric ceramics plate 1. The depth of each groove 12 is gradually reduced as it approaches a rear end surface 15 of the piezoelectric ceramics plate 1 to form a shallow groove 16 near the rear end surface 15. Thereafter, the metal electrodes 13 are formed on the side walls 11 by a known technique, such as sputtering. Then, the protective films 20 covering the metal electrodes 13 are formed using a dry or wet process.

On the other hand, the ink inlet hole 21 and the manifold 22 are formed in the cover plate 2 made of a ceramics or a resin material by grinding or cutting. Then, the lower surface of the cover plate 2, in which the manifold 22 is formed, is bonded to the upper surface of the piezoelectric ceramics plate 1, in which the grooves 12 are formed, by means of an epoxy adhesive or the like. Then, a nozzle plate 31, having the nozzles 32 arranged at positions corresponding to the front end positions of the grooves 12, is bonded to the front end surface of the assembly of the piezoelectric ceramics plate 1 and the cover plate 2. A substrate 41 having a plurality of conductor film patterns 42 arranged at the positions corresponding to the rear end positions of the grooves 12 is bonded to the lower surface of the piezoelectric ceramics plate 1 on the opposite side of the cover plate 2 by means of an epoxy adhesive or the like. Each conductor film pattern 42 is connected by wire bonding through a conductor wire 43 to the metal electrode 13 formed on the bottom surface of the shallow groove 16 contiguous to the corresponding groove 12.

The control unit, for controlling the ink ejecting printer head shown in FIG. 5, will be described with reference to FIG. 8 which is a block diagram of the control section. The conductor film patterns 42 formed on the substrate 41 are individually connected to an LSI chip 51. Also connected to the LSI chip 51 are a clock line 52, a data line 53, a voltage line 54, and a ground line 55. The LSI chip 51 determines which nozzle 32 the ink droplets are to be expelled from according to data appearing on the data line 53 on the basis of continuous clock pulses supplied from the clock line 52. Then, according to the result of determination, the LSI chip 51 applies a voltage V of the voltage line 54 to the conductor film pattern 42 connected to the metal electrode 13 in the groove 12 to be driven. Further, the LSI chip 51 applies the zero voltage of the ground line 55 to the other conductor film patterns 42 connected to the metal electrodes 13 in the grooves 12 not to be driven.

In the ink ejecting printer head having the structure described above, it has conventionally been considered that an inactive, inorganic passive film, for example an alternately laminated film of silicon nitride (SiNx) and silicon oxynitride (SiON), is preferable for the protective film 20 that is provided for the purpose of insulating and protecting the metal electrode 13 or for preventing corrosion of the metal electrode 13 itself.

However, the use of such an inorganic material for the protective film 20 for insulating and protecting the metal electrode 13 in the ink ejecting printer head causes a problem because the metal electrode 13 cannot be perfectly protected as the protective film 20 cannot be formed on a recessed portion due to a shadow effect of unevenness peculiar to the piezoelectric ceramics plate 1 as a bed or unevenness of the metal electrode 13 affected by the unevenness of the piezoelectric ceramics plate 1. Further, a surface roughness Ra of the protective film 20 has an influence upon variations of ink droplets to be expelled and upon an average volume of the ink droplets. If the surface roughness Ra is large, the segregation of ink components occurs to increase the variations of the ink droplets and decrease the average volume of the ink droplets, thus deteriorating the ejecting characteristics of the ink ejecting printer head. Moreover, when a segregated substance of ink components comes near the nozzle, an ink expelling direction may be changed or the expelling of ink may be hindered to cause an expulsion defect.

SUMMARY OF THE INVENTION

In view of the problems mentioned above, it is an object of the invention to provide an ink ejecting printer head having durability and good and stable ejecting characteristics.

Another object of the invention is to provide a lower cost to producing the ink ejecting printer head by omitting the bonding step.

To achieve the above objects, the ink ejecting printer head of the invention comprises a piezoelectric ceramics plate having a plurality of walls defining ink chambers, an electrode provided in each ink chamber for driving and deforming the walls of the piezoelectric ceramics plate and a protective film provided on the electrode for insulating and protecting the electrode, the protective film formed of an organic material having a surface roughness Ra of 3 μm or less.

In the ink ejecting printer head of the invention as described above, the organic protective film having the surface roughness Ra of 3 μm or less covers the electrode perfectly and uniformly irrespective of the unevenness peculiar to the piezoelectric ceramics plate as a bed and the unevenness of the electrode as affected by the unevenness of the piezoelectric ceramics plate. Therefore, the segregation of ink components can be eliminated and the variations in the ink droplets being expelled can be reduced.

As apparent from the above description, according to the invention, an organic material is used as the protective film in the ink ejecting printer head, and the surface roughness Ra of the protective film is set to 3 μm or less. Accordingly, the segregation of ink components is suppressed to ensure a smooth flow of the ink. As a result, the variations in the ink droplets ejected can be reduced and the ejecting stability can be improved.

Further, according to the invention, because an organic material is used as the protective film and the adhesive inside of the ink ejecting printer head, the printer head prevents the inner stress caused when the adhesive is hardened and the adhesive strength can be improved. Therefore, the strength of the ink chambers is improved and ink ejecting printer heads having good ejecting stability and durability against the deformation of the walls can be manufactured.

Moreover, according to the invention, because the protective film for protecting and insulating the electrodes is extended to at least a portion of the upper surface of the walls and bonds the side walls and the cover plate, ink ejecting printer heads of good stability can be manufactured with a low cost.

BRIEF DESCRIPTION OF THE DRAWINGS

Preferred embodiments of the invention will be described in detail with reference to the following figures wherein.

DETAILED DESCRIPTION OF PREFERRED EMBODIMENTS

Preferred embodiments of the invention will now be described. The explanation of the structure of the ink ejecting printer head, at least those features which is are similar to those of the related art, is omitted in this embodiment.

Figure 1:
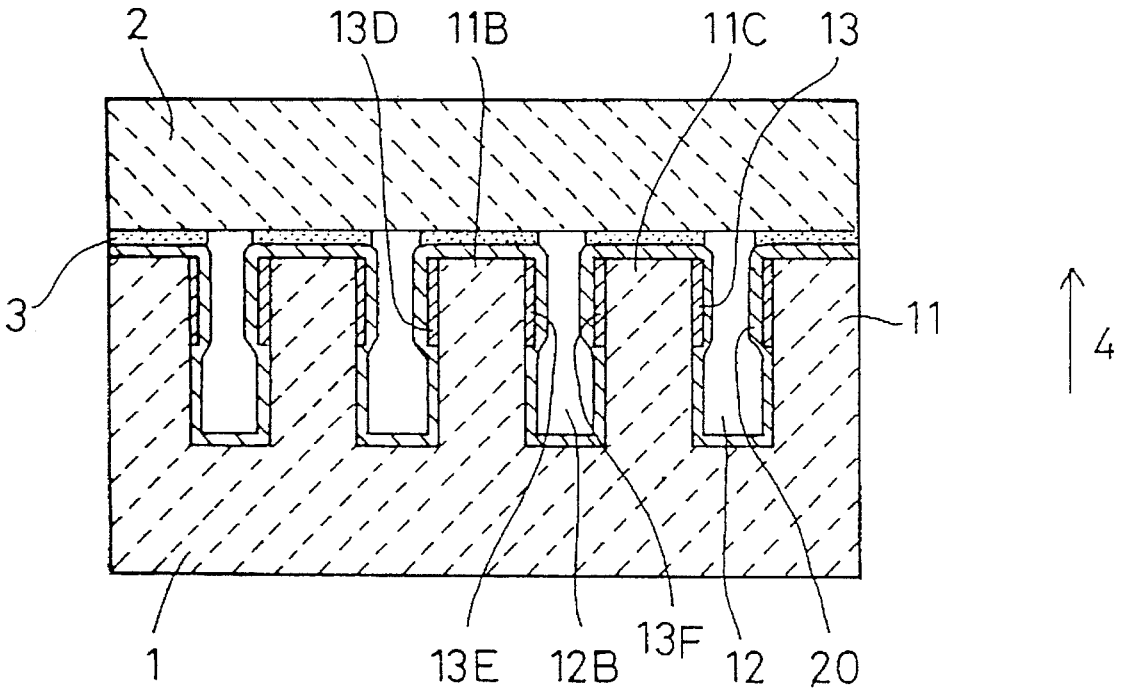
FIG. 1 is a sectional view showing the structure of an ink ejecting printer head of the embodiment.

The first embodiment is explained with reference to FIG. 1. In the first embodiment, an organic material such as an epoxy resin or polyimide is used for the protective film 20 instead of the inorganic material used for the protective film 20 in the related art. If an inorganic material is used for the protective film 20, the protective film 20 cannot be formed on a recessed portion due to the shadow effect of the unevenness peculiar to the piezoelectric ceramics plate 1 as a bed or the unevenness of the metal electrode 13 affected by the unevenness of the piezoelectric ceramics plate 1, resulting in imperfect protection of the metal electrode 13.

The organic film as the protective film 20 in this embodiment is formed in the following manner. First, the piezoelectric ceramics plate 1 having the metal electrodes 13 is attached to a spin coater by using a vacuum and about 1g of epoxy resin, e.g., EPO-TEK (manufactured by Epoxy Technology), or polyimide, e.g., PYRALIN (manufactured by Du Pont), is dropped on the piezoelectric ceramics plate 1. The spin coater is then rotated at 3000 rpm to apply the epoxy resin or the polyimide to the surface of the piezoelectric ceramics plate 1. Thereafter, the epoxy resin or the polyimide applied to the piezoelectric ceramics plate 1 is baked at 150° C. for 1 hour in a clean oven to form an organic film of the epoxy resin or the polyimide with a film thickness of 10 μm or less in the grooves 12 and the upper surfaces of the side walls 11. In this process, the surface roughness Ra of the organic film is set to 3 μm or less to thereby improve the characteristics of the protective film 20 for the following reason.

The whole inside surface of each groove 12 forming the ink channel inclusive of the surface on which the metal electrodes 13 are formed has a surface roughness of about 3 to 8 μm depending on the size of particles constructing the piezoelectric ceramics plate 1. The surface roughness of the organic film formed by the spin coating method may follow the unevenness of the piezoelectric ceramics plate 1 as a bed or can be improved by filling the unevenness of the piezoelectric ceramics plate 1 as a bed according to various conditions such as a rotating speed, viscosity of the resin solution, and the drop quantity of the resin solution.

For example, the surface roughness Ra of 3 μm or less of the organic film can be obtained in the following manner. An epoxy resin solution having a viscosity of 500 cps is dropped onto the piezoelectric ceramics plate 1 when the spin coater is stationary. Then, the rotating speed of the spin coater is increased from 0 rpm to a final speed of 4000 rpm in 10 seconds. Then, the final speed of 4000 rpm is maintained for about 10 seconds. Finally, the coated piezoelectric ceramics plate 1 is baked at 150° C. for one hour. How a surface roughness of Ra of 3 μm or less of the organic film influences the ejecting characteristics was confirmed through the following test.

A piezoelectric ceramics plate 1 having ten ink channels was used. An electrode film was formed by vapor deposition on each side wall 11 at an upper half portion thereof. Each side wall 11 has a thickness of 80 μm and a height of 500 μm, and each ink channel has a width of 90 μm. An organic protective film was formed on the electrode film in each ink channel of the piezoelectric ceramics plate 1 by using an epoxy resin solution. Several samples of the organic protective film were prepared by diluting the epoxy resin solution with an organic solvent, such as acetone, to vary the viscosity of the epoxy resin solution and the rotating conditions were also varied. Further, samples having different surface roughnesses were used. An adhesive layer 3 was formed on the upper surface of each side wall 11 of the piezoelectric ceramics plate 1 having the organic protective film 20 formed thereon, and a cover plate 2 was bonded using an adhesive layer 3 to the piezoelectric ceramics plate 1. Thereafter, a circuit board was connected to the piezoelectric ceramics plate 1 by wire bonding to prepare a head unit capable of supplying pulses for ejecting ink. A pigment ink was used as the ink.

Figure 2:
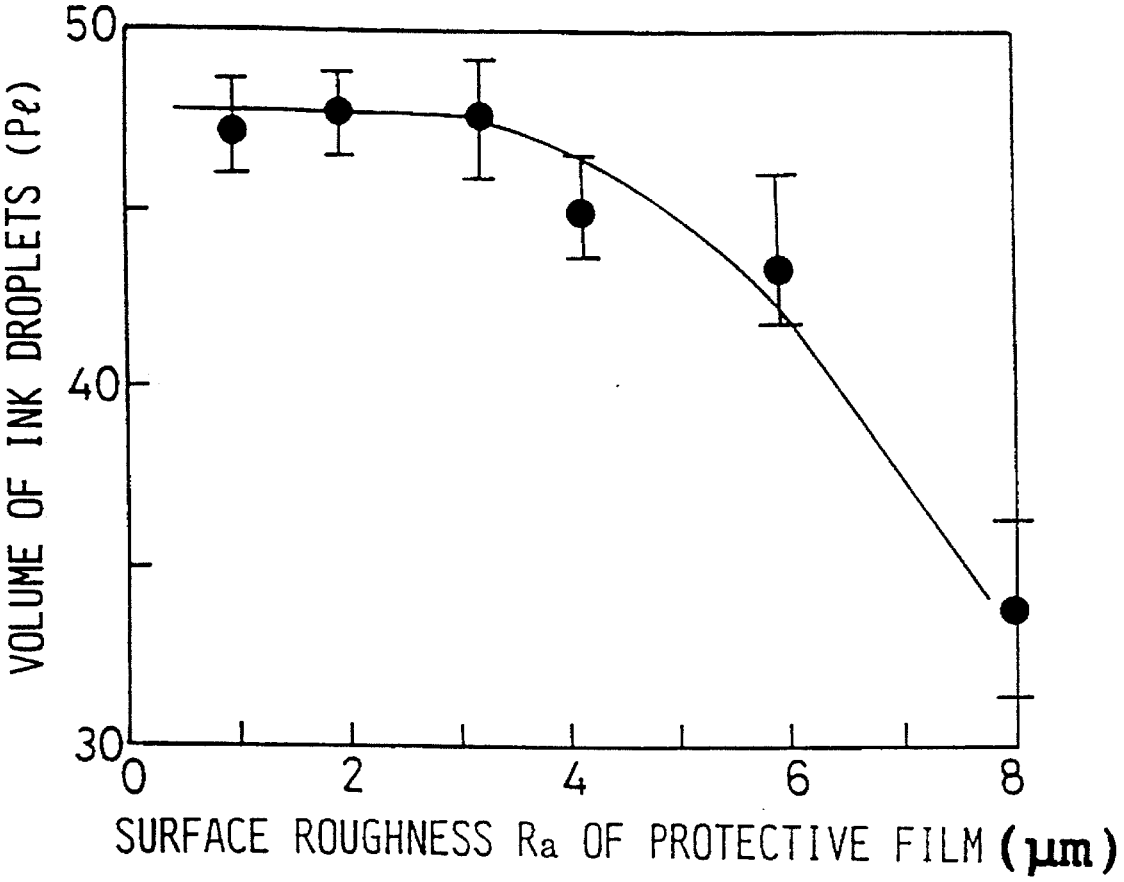
FIG. 2 is a graph showing the relationship between the surface roughness Ra of a protective film and the volume of droplets as well as the variations of droplets.

Then, a given voltage was applied to the head unit for a given time to carry out an ink ejecting test. In the ink ejecting test, the sizes of ink droplets ejected were detected by using a CCD and measured on a monitor. After the ink ejecting test, the samples were broken apart to measure the surface roughness Ra of the organic protective film by using a surface roughness tester. The test results are shown in FIG. 2. As FIG. 2 shows, there is a tendency that when the surface roughness Ra is greater than 3, the variations in the volumes of the ink droplets increase and the average volume of the ink droplets decreases. This tendency is considered to be due to the following described mechanism.

When the surface roughness of the organic protective film 20 is large, an ink component, such as carbon, contained in the pigment ink is adsorbed to recessed portions on the surface of the film 20 because the film 20 is in contact with the ink. When even one molecule of the ink component is so adsorbed, a growth in adsorption of successive molecules occurs. However, the bonding strength regarding the adsorbed molecules is relatively weak. Accordingly, the bonding between the molecules or the bonding between the root molecule and the organic protective film 20 is easily broken, and many clusters of the molecules thus freed become suspended in the ink solution. The clusters are moved in the ink solution to reach the nozzle of the nozzle plate where they hinder ejection of the ink from the nozzle. It is believed this is the reason the ink ejecting quantity was reduced in the above ink ejecting test.

Further, it is believed that the clusters may cause a serious problem such that the ink ejecting direction is changed or, in the worst case the ink is not ejected. Even if the clusters do not come near the nozzle, the presence of the clusters in the ink solution causes a change in the physical properties, such as viscosity, of the ink to hinder the flow of the ink, thus deteriorating the ejecting characteristics. Consequently, it is essential to set the surface roughness Ra of the organic protective film to 3 μm or less, thereby obtaining an ink ejecting printer head having good and stable ejecting characteristics.

The second embodiment is explained below. In the second embodiment, organic materials are used as the material of the protective film 20 and the material of the adhesive layer 3 for bonding the piezoelectric ceramics plate 1 and the cover plate 2. The advantage of using organic materials in this manner was confirmed through the following test.

A piezoelectric ceramics plate having ten ink channels was used for a sample. Each side wall of the piezoelectric ceramics plate has a thickness of 80 μm and a height of 500 μm, and each ink channel has a width of 90 μm. An organic protective film, as the protective film 20, was formed on the piezoelectric ceramics plate using an organic polyimide solution. More specifically, the polyimide solution was spin-coated on the piezoelectric ceramics plate 1 by the spin coating method previously described. The coated piezoelectric ceramics plate 1 was then baked at 150° C. for one hour to form a polyimide film having a thickness of 10 μm or less in each groove 12 and on the upper surface of each side wall 11. An even better polyimide film may be obtained by infrared irradiation during the baking.

In the next step, an organic adhesive layer as the adhesive layer 3 was formed on the organic protective film formed on the upper surface of each side wall 11 by using a two-part epoxy resin. More specifically, a primary agent and a curing agent constituting the two-part epoxy resin were mixed and agitated, and then the mixture was forcibly applied to the organic protective film formed on the upper surface of each side wall 11 to thereby form an epoxy adhesive layer having a thickness of a few micrometers. Thereafter, the cover plate 2 was placed on the epoxy adhesive layer formed on the piezoelectric ceramics plate 1, and is then baked to thereby cure the epoxy adhesive layer. Thus, the cover plate 2 was bonded to the piezoelectric ceramics plate 1.

As a comparative sample, an $SiO_2$ film as an inorganic protective film having a coefficient of linear expansion smaller than that of the epoxy adhesive by about two orders was used instead of the organic protective film. That is, the $SiO_2$ film having a thickness of 10 μm or less was formed both in each groove 12 and on the upper surface of each side wall 11 of the piezoelectric ceramics plate 1 having the same form as the above by using a known technique such as sputtering. Then, the cover plate 2 was bonded to the piezoelectric ceramics plate 1 by the epoxy adhesive in the same procedure as described above.

Figure 3A:
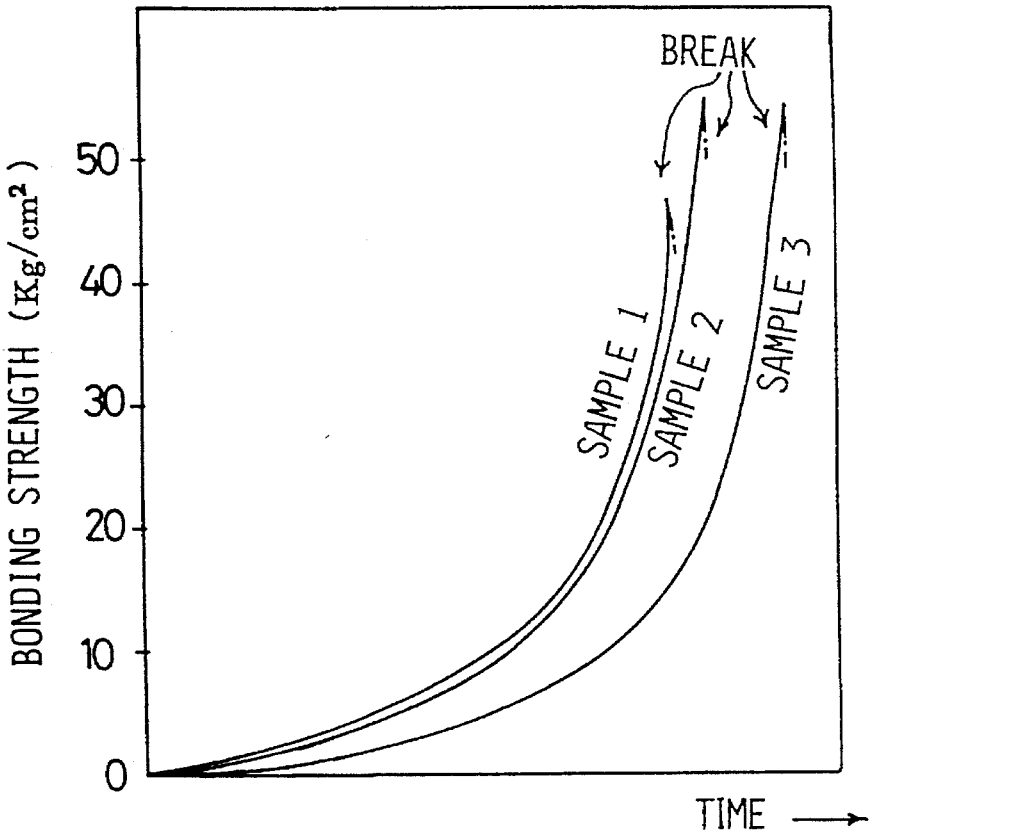
FIG. 3A is a graph showing the bonding strength between an organic protective film and an organic adhesive layer.
Figure 3B:
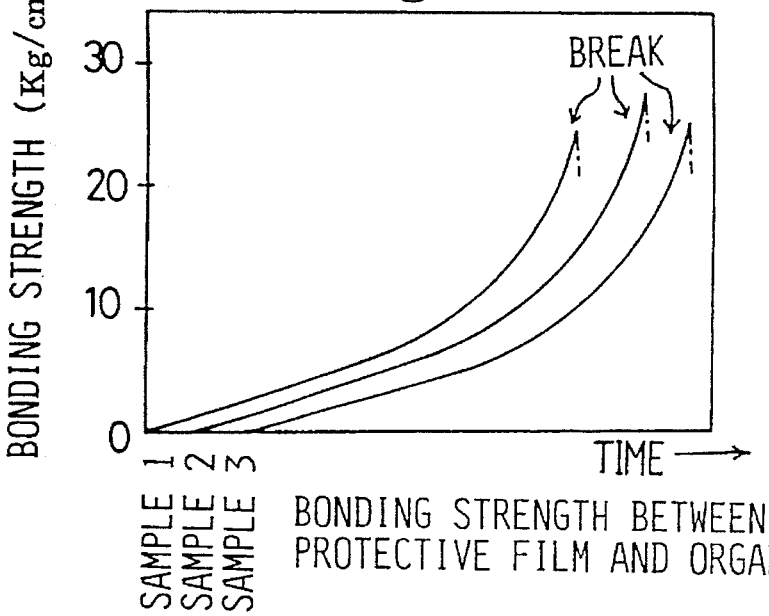
FIG. 3B is a graph showing the bonding strength between an inorganic protective film and an organic adhesive layer.

Three samples of the organic protective film and three comparative samples of the inorganic protective film were similarly prepared. All the samples were subjected to measurement of the bonding strength between the cover plate 2 and the piezoelectric ceramics plate 1 using a tension tester. The measurement of the bonding strength was performed by gradually applying a load to the piezoelectric ceramic plate 1 and the cover plate 2, bonded together with use of each sample, and measuring the breaking load. The test results are shown in FIGS. 3A and 3B, wherein the axis of the abscissa represents a lapse of time and the axis of the ordinate represents the applied load. As is apparent from FIG. 3A, an average breaking load using the organic protective film samples is about 51 $kg/cm^2$ and, as shown in FIG. 3B, the average breaking load using the inorganic protective film samples is about 25 $kg/cm^2$. Thus, it was found that the organic protective film is superior in adhesion to the inorganic protective film.

The reason why the average breaking load in using the inorganic protective film samples is low is considered to be that when the two materials bonded together, different from one another in coefficients of linear expansion, are baked for curing, stress due to the difference in the coefficients of linear expansion occurs in the interface between the protective film 20 and the adhesive layer 3 to reduce a breaking adhesive strength. More specifically, the polyimide film as the organic protective film has a coefficient of linear expansion of about $2\text{–}5\times10^{31}$ $^{5}$°C.$^{-1}$ which, however, varies with the kind of the polyimide solution used. The epoxy resin as the adhesive has a coefficient of linear expansion of about $2\times10^{-5}$°C.$^{-1}$. Both a $SiO_2$ film and a SiNx film, excellent in insulation and protection properties, used as the inorganic protective film have a coefficient of linear expansion of about $5\times10^{-7}$°C.$^{-1}$.

Accordingly, the samples using the organic films as the protective film 20 having a coefficient of linear expansion of the same order are the adhesive layer 3 improve the adhesion between the piezoelectric ceramics plate 1 and the cover plate 2 so that the durability against the deformation of the side walls upon ejecting can be improved. Further, the wettability between the inorganic protective film and the organic adhesive is bad, and therefore they are hard to conform to each other upon baking, thus causing a possibility of further reduction in adhesive strength. Consequently, by the use of organic films for both the protective film and the adhesive, the adhesive strength can be increased to thereby improve the ejecting stability and the durability against the deformation of the side walls of the piezoelectric ceramics plate upon ejecting ink in the ink ejecting printer head according to the embodiments.

Figure 4:
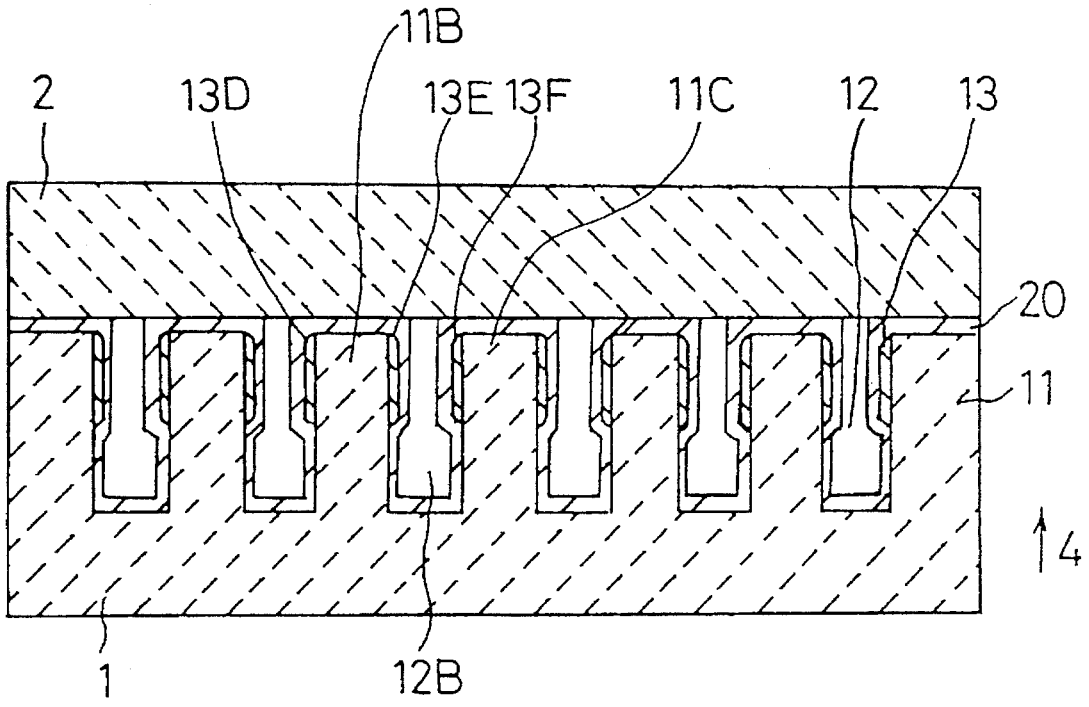
FIG. 4 is a sectional view showing the structure of the ink ejecting printer head of another preferred embodiment.
Figure 5:
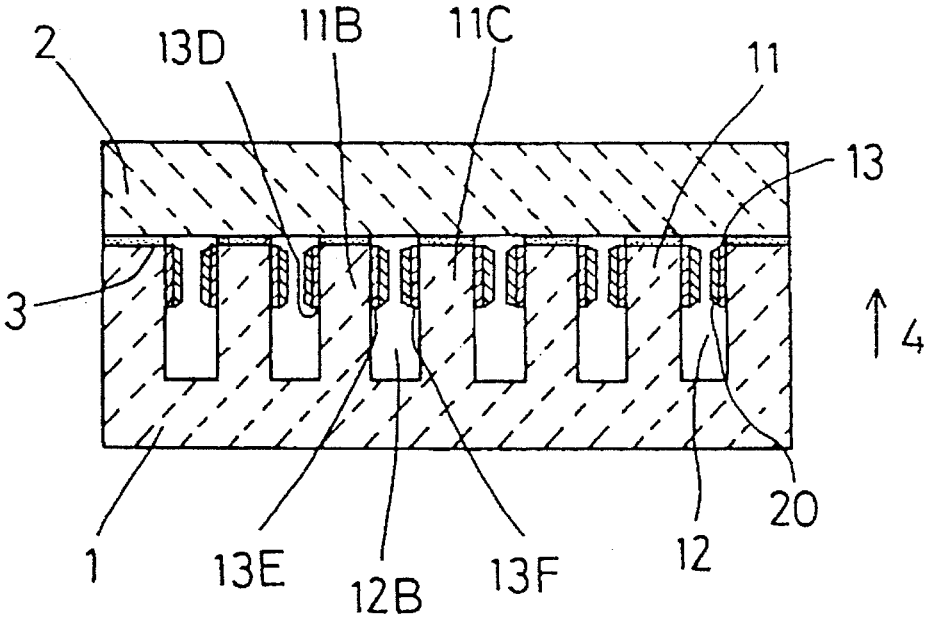
Fig.5 RELATED ART
FIG. 5 is a sectional view showing the structure of an ink ejecting printer head of the related art.
Figure 6:
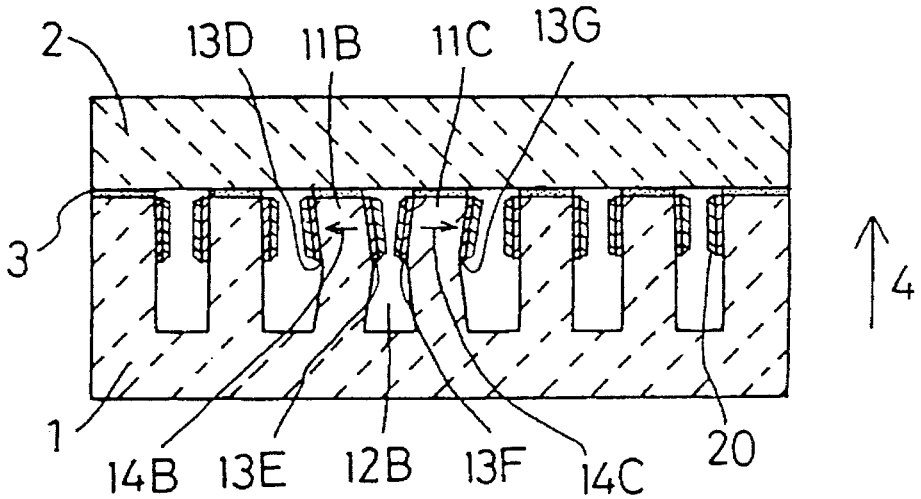
Fig.6 RELATED ART
FIG. 6 is a sectional view showing the operation of the ink ejecting printer head of the related art.
Figure 7:
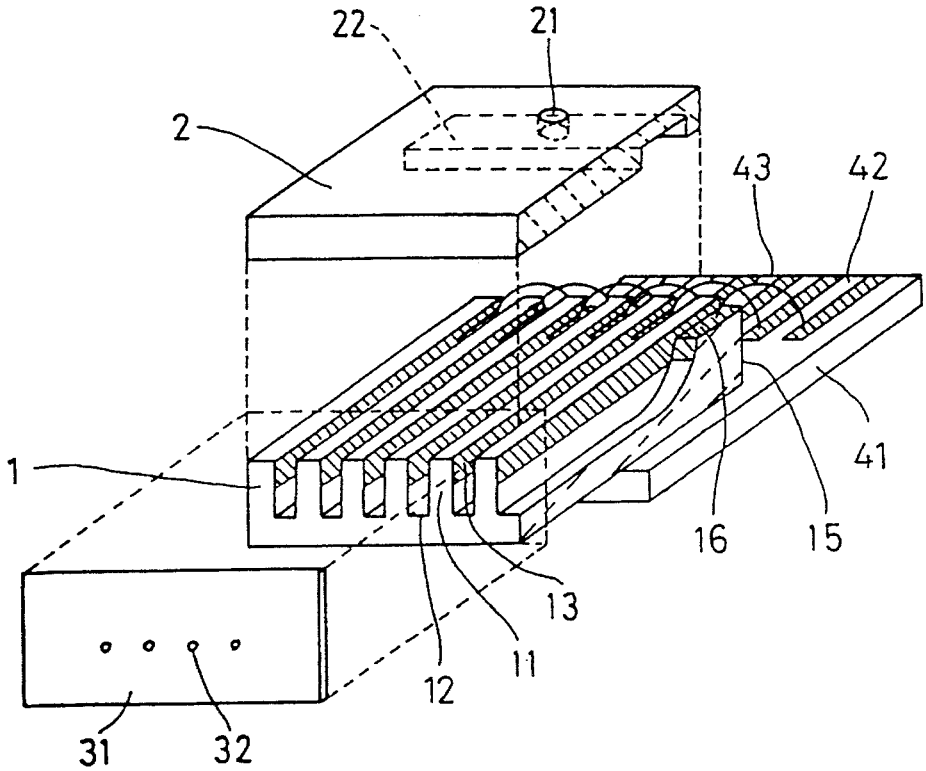
Fig.7 RELATED ART
FIG. 7 is an exploded perspective view showing the structure of the ink ejecting printer head of the related art.
Figure 8:
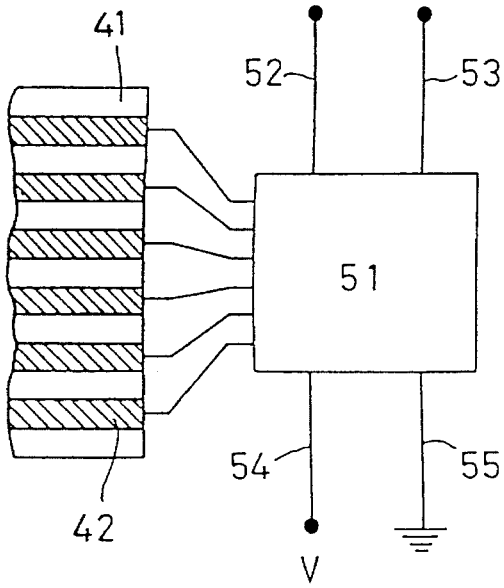
Fig.8 RELATED ART
FIG. 8 is a block diagram of a control unit for the ink ejecting printer head of the related art.

The third embodiment is explained with reference to FIG. 4. In the third embodiment, an organic material, especially, an epoxy resin, is used as the material of the protective film 20 and also serves as the adhesive for bonding the piezoelectric ceramics plate 1 and the cover plate 2. For example, an appropriate quantity of epoxy resin, e.g., EPO-TEK 377 (manufactured by Epoxy Technology) is dropped on the piezoelectric ceramics plate 1, and is then spin-coated at a rotating speed of 3000 rpm to thereby form an epoxy resin film having a thickness of 10 μm or less in each groove 12 and on the upper surface of each side wall 11 of the piezoelectric ceramics plate 1. Immediately after the formation of the epoxy resin film, the cover plate 2 is placed on the piezoelectric ceramics plate 1 through the epoxy resin film, and is lightly pressed so as to be attached to the piezoelectric ceramics plate 1. Then, the assembly is baked at 150° C. for 1 hour in a clean oven to complete curing of the epoxy resin film.

Accordingly, as compared with the manufacturing method of the related art wherein the adhesive layer is formed on the upper surface of each side wall after forming the protective film, and the cover plate is then bonded to the piezoelectric ceramics plate, the printer head of the third embodiment has the advantage that the formation of the protective film and the formation of the adhesive layer are simultaneously performed. That is, as shown in FIG. 4, the organic protective film 20 is formed in each groove 12 and between the piezoelectric ceramics plate 1 and the cover plate 2 to bond them together. Accordingly, the manufacturing steps are greatly simplified. In addition, since the protective film serves also as the adhesive layer to continuously protect the electrode films 13 also at the upper corners of each side wall 11, the stability of the printer head can be improved. Thus, both simplifying the manufacturing steps and improved stability of the printer head are provided by the third embodiment.

It is to be understood that the invention is not restricted to the particular forms shown in the foregoing embodiment. Various modifications and alternations can be made thereto without departing from the scope of the invention encompassed by the appended claims.

What is claimed is:

1. An ink ejecting printer head, comprising:

a piezoelectric ceramics plate having a plurality of walls with an ink chamber defined between each opposing pair of walls;

an electrode on each said opposing pair of walls defining said ink chamber for deforming said walls of said ink chamber when a current is applied thereto;

an organic protective film completely covering each said electrode for insulating and protecting said electrode, said organic protective film having a surface roughness Ra over an entire surface of no greater than 3 μm; and a cover plate mounted on an end surface of each wall of the plurality of walls using an organic adhering member.

2. The ink ejecting printer head as claimed in claim 1, wherein the organic protective film is made of one of an epoxy organic material and a polyimide organic material.

3. The ink ejecting printer head as claimed in claim 1, wherein the cover plate is mounted on the end surface of each wall of the plurality of walls and said organic protective film is extended over the end surface of each wall of the plurality of walls where said cover plate is mounted, thereby adhering said cover plate to the plurality of walls.

4. An ink ejecting printer head, comprising:

a piezoelectric ceramics plate having a plurality of walls with an ink chamber defined between each opposing pair of walls;

an electrode on each said opposing pair of walls defining said ink chamber for deforming said walls of said ink chamber when a current is applied thereto;

a cover plate mounted on an end surface of each wall of the plurality of walls with an adhering member; and a protective film formed to completely cover each said electrode for insulating and protecting said electrode, wherein said protective film and the adhering member are formed of an organic material, said protective film having a surface roughness Ra of less than 3 μm.

5. An ink ejecting printer head, comprising:

a piezoelectric ceramics plate having a plurality of walls with an ink chamber defined between each opposing pair of walls;

an electrode on each said opposing pair of walls defining said ink chamber for deforming said walls of said ink chamber when a current is applied thereto;

a cover plate mounted on an end surface of each wall of the plurality of walls by an adhering member; and an organic protective film provided on each said electrode and extended to cover the end surface of each wall of said plurality of walls where said cover plate is provided, said protective film for insulating and protecting said electrodes, wherein said protective film has a surface roughness Ra no greater than 3 μm.

6. The ink ejecting printer head as claimed in claim 5, wherein said protective film on the end surface of each wall comprises said adhering member.

7. The ink ejecting device as claimed in claim 5, wherein said organic film comprises an epoxy resin or a polyimide.

8. The ink ejecting printer head as claimed in claim 4, wherein the protective film and the adhering member are made of the same organic material.

9. The ink ejecting printer head as claimed in claim 4, wherein the protective film is provided on an inner surface of each said ink chamber.

10. The ink ejecting printer head as claimed in claim 1, wherein the protective film is provided on a facing surface of each wall of said plurality of ink chambers.

11. The ink ejecting printer head as claimed in claim 5, wherein the protective film is provided on a facing surface of each wall of said plurality of ink chambers.

* * * * *